United States Patent [19]

Freeman

[11] Patent Number: 4,645,962

[45] Date of Patent: Feb. 24, 1987

[54] SLIP RING ASSEMBLY AND METHOD OF MAKING

[75] Inventor: Jerry H. Freeman, Mt. Prospect, Ill.

[73] Assignee: ROL Industries Inc., Chicago, Ill.

[21] Appl. No.: 656,071

[22] Filed: Sep. 28, 1984

[51] Int. Cl.[4] ..... H01R 39/08

[52] U.S. Cl. ..... 310/232; 310/235

[58] Field of Search ..... 310/232, 233–236; 339/5 R

[56] References Cited

U.S. PATENT DOCUMENTS

| | | | |
|---|---|---|---|
| 3,289,140 | 11/1966 | Slack | 310/232 X |
| 3,636,394 | 1/1972 | Forste et al. | 310/232 |
| 4,209,213 | 6/1980 | Wussow | 310/232 X |
| 4,403,164 | 9/1983 | Preece | 310/232 |
| 4,535,264 | 8/1985 | Allport | 310/235 X |

*Primary Examiner*—Donovan F. Duggan

*Attorney, Agent, or Firm*—Dressler, Goldsmith, Shore, Sutker & Milnamow, Ltd.

[57] ABSTRACT

A slip ring assembly for an alternator or like electrical apparatus is disclosed which has been particularly configured for highly efficient formation by an injection molding process. The assembly includes a unitary body configured for mounting on the rotor shaft of the associated apparatus, with the assembly further including first and second axially spaced slip ring members positioned on the body. First and second terminals are provided which are respectively electrically joined to the first and second slip ring members, with the terminals extending axially of the body and outwardly of an end of the body which is adjacent to the first slip ring member. The configuration of the body of the assembly is such that it can be very efficiently injection molded, with the slip ring members and terminal elements thereafter positioned on the body for completing fabrication of the assembly.

4 Claims, 8 Drawing Figures

FIG. 1
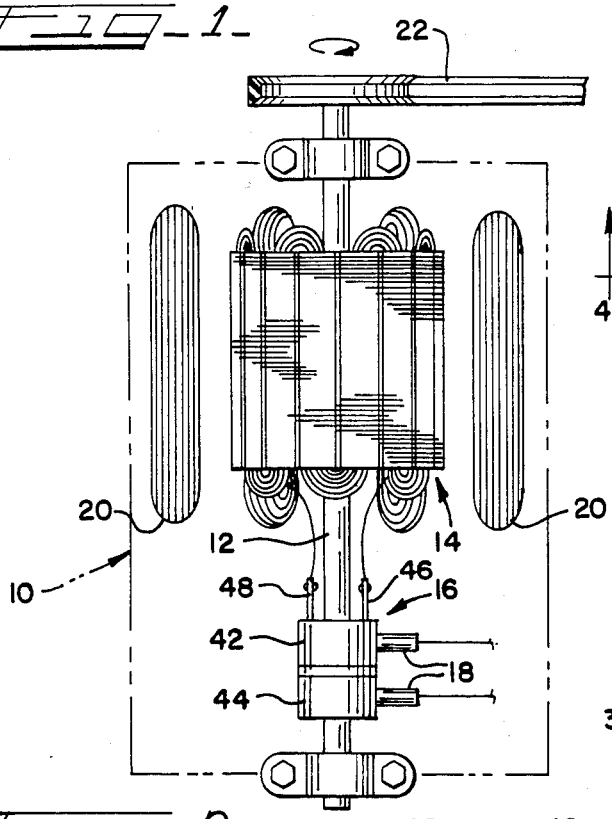
FIG. 3
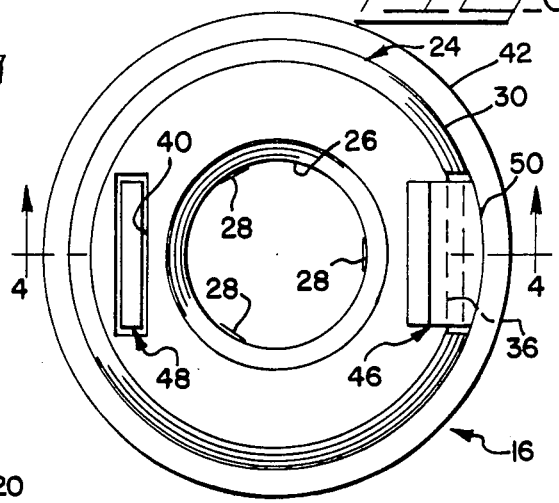
FIG. 4
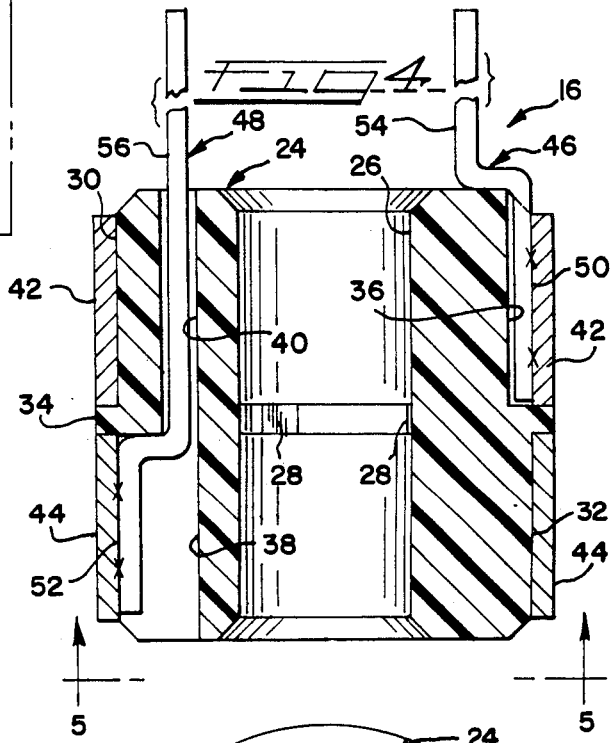
FIG. 2
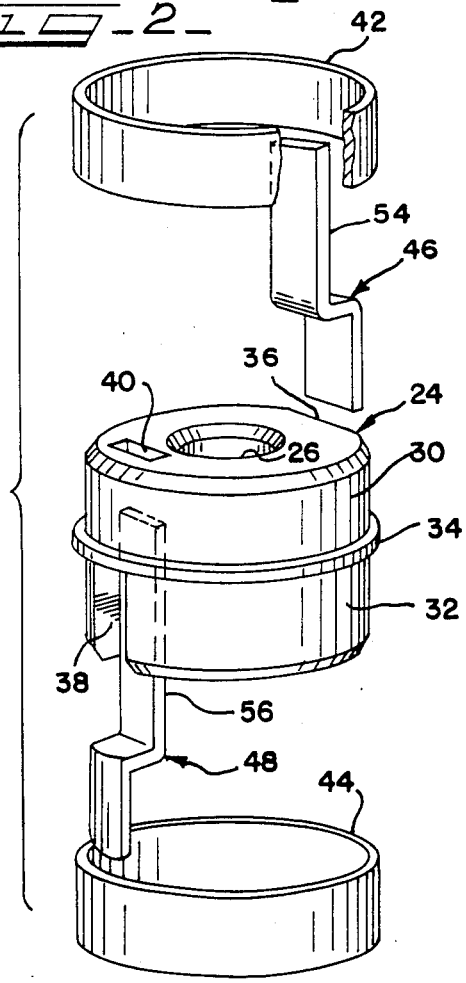
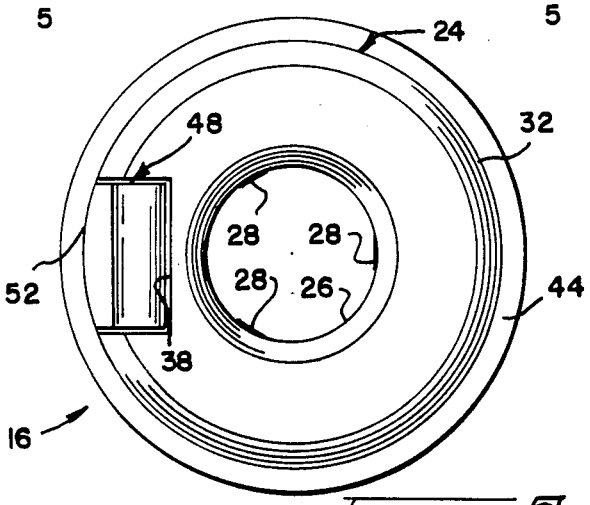
FIG. 5

SLIP RING ASSEMBLY AND METHOD OF MAKING

TECHNICAL FIELD

The present invention relates generally to alternators and like current-generating devices, and more particularly to a slip ring assembly for mounting on the rotor shaft of an alternator or the like wherein the assembly has been configured for highly efficient manufacture. A method of making the slip ring assembly is also disclosed.

BACKGROUND OF THE INVENTION

A slip ring assembly is provided on the rotatable rotor shaft of some types of electrical generating devices for effecting an electrical connection between the rotor of the device and associated, relatively fixed electrical contact brushes. Such an assembly typically includes an electrically non-conductive body which carries a pair of axially spaced, annular members referred to as slip rings. A pair of terminals are respectively electrically joined to the slip rings. The terminals typically extend axially from one end of the assembly, and are electrically joined to the windings of the rotor assembly. The slip rings are positioned for respective electrical contact with a pair of relatively fixed, non-rotating brushes, thus providing the desired electrical connection between the brushes and the rotor assembly. Such an arrangement is typical of the construction of an automobile alternator and like electrical current generating devices.

Slip ring assemblies of the above type have typically been manufactured by a compression molding process. Specifically, each of the slip rings of the assembly is formed and joined to a respective one of the pair of terminals. Each slip ring and its terminal are then positioned within a molding cavity, with the slip rings positioned in the desired axially spaced relationship. A charge of electrically non-conductive moldable material is then introduced into the mold cavity, and the mold cavity is closed so as to form the body of the slip ring assembly from the moldable material. During molding, the body is typically formed with an axial bore to facilitate mounting on the associated rotor shaft, with the moldable material flowing against the slip rings and their respective terminals to permanently affix the slip rings in the desired axially spaced relation while electrically isolating each slip ring and its respective terminal from the other.

While the above compression molding technique provides a slip ring assembly having the necessary functional characteristics, formation by compression molding is relatively inefficient and expensive when compared to injection molding manufacturing methods. It is thus highly desirable to provide a slip ring assembly for an alternator or like electrical apparatus which can be efficiently formed by injection molding.

SUMMARY OF THE INVENTION

A slip ring assembly for an alternator or like electrical apparatus is disclosed which has been specifically configured for highly efficient formation by injection molding. Relatively inefficient compression molding techniques are thus avoided, desirably resulting in cost savings for manufacture of the assembly, while still providing a slip ring assembly exhibiting the necessary strength and electrical conductivity characteristics.

The slip ring assembly embodying the principles of the present invention is configured for mounting on a rotatable rotor shaft of an electrical apparatus including relatively fixed contact brushes, such as an alternator. The slip ring assembly includes a unitary (i.e., one-piece) injection molded body comprising electrically non-conductive material. Readily molded plastic material, such as nylon and the like, which exhibits the desired electrical insulating characteristics can be suitably employed. The injection molded body is preferably provided with a generally cylindrical configuration, and is formed to define an axial bore for receiving the associated rotor shaft therein. In the illustrated embodiment, the molded body is formed with first and second axially spaced outer peripheral surfaces which respectively include first and second axially extending channels.

The present assembly further includes first and second electrically conductive annular slip ring members respectively positioned on the outer peripheral surfaces of the body in axially spaced relation. The first and second slip ring members are thus positioned for electrical contact with the contact brushes of the associated electrical apparatus.

The present slip ring assembly further includes first and second electrically conductive terminals which are respectively electrically joined with the first and second slip ring members. In the preferred form, the first terminal extends axially from within the first channel of the molded body outwardly of an end of the body which is adjacent to the first slip ring member.

The second terminal similarly extends from within the second channel of the molded body, and further extends axially through the body inwardly of the first slip ring member, and outwardly of the one end of the body adjacent to the first slip ring member. In the preferred embodiment, the molded body defines an axial internal passage which is aligned with and opens into the second channel defined by the body. The second terminal thus extends from within the second channel and through the internal passage such that the second terminal is electrically isolated or insulated from the first slip ring member.

In order to retain the first and second slip ring members in position on the molded body of the assembly, an interference fit is preferably effected between the slip ring members and the body. In an alternate embodiment, a plurality of deformable tabs are provided on each of the slip ring members, with the tabs interengaged with the body of the assembly for positively locking and retaining the slip ring members in position on the body.

From the above, the efficiency with which the present slip ring assembly can be made will be readily appreciated. The body of the assembly can be efficiently formed by conventional injection molding techniques. The annular slip ring members can be efficiently formed from a tubular extrusion, while the first and second terminals can be easily formed by stamping or the like.

In the preferred form of the present method, the first and second terminals are respectively electrically joined to the first and second annular slip ring members prior to positioning of the slip ring members and the terminals on the molded body of the assembly. After the terminals and slip ring members are respectively joined, they can easily be fitted to the injection molded body. As noted, the slip ring members are retained in position on the body by either an interference fit, and/or by providing each slip ring member with deformable tabs which can be deformed into interengagement with the body.

Significantly, formation of the present slip ring assembly in accordance with the teachings herein permits the assembly to be formed with a relatively reduced external diameter. This not only desirably results in material savings, but further acts to relatively lower the peripheral speed of the assembly (for a given rotational speed), thus desirably reducing the wear of the associated electrical contact brushes.

Numerous other features and advantages of the present invention will become readily apparent from the following detailed description, the accompanying drawings, and the appended claims.

BRIEF DESCRIPTION OF THE DRAWINGS

FIG. 1 is a simplified diagrammatic view of an electrical apparatus, illustrated as an alternator, having a slip ring assembly embodying the principles of the present invention;

FIG. 2 is an exploded perspective view of the slip ring assembly illustrated in FIG. 1;

FIG. 3 is an end view of the present slip ring assembly;

FIG. 4 is a cross-sectional view taken generally along lines 4—4 of FIG. 3;

FIG. 5 is an opposite end view of the present slip ring assembly taken along lines 5—5 of FIG. 4;

DETAILED DESCRIPTION

Figure 6:
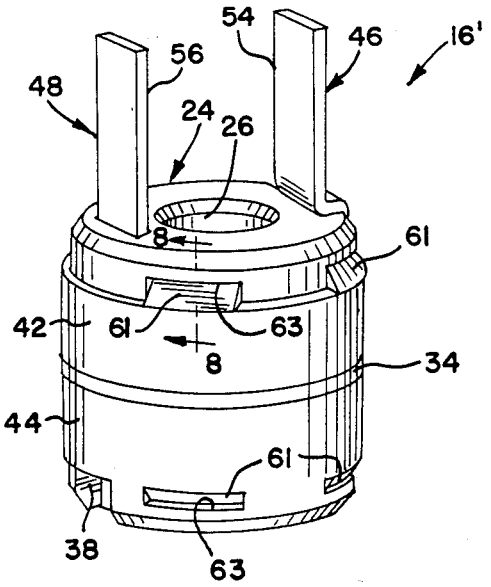
FIG. 6 is a perspective view of an alternate embodiment of the present slip ring assembly.

While the present invention is susceptible of embodiment in various forms, there is shown in the drawings and will hereinafter be described first and second embodiments of the invention, with the understanding that the present disclosure is to be considered as an exemplification of the invention, and is not intended to limit the invention to the specific embodiments illustrated.

With reference first to FIG. 1, a simplified form of an electrical apparatus comprising an alternator 10 is diagramatically illustrated. As will be recognized with those familiar with the art, alternator 10 typically includes a rotatable rotor shaft 12 which carries a rotor assembly 14 comprising a core and windings. A slip ring assembly 16 embodying the principles of the present invention is further mounted on the rotor shaft 12 for rotation therewith, and is provided for effecting an electrical connection between the windings of rotor assembly 14 and relatively fixed, non-rotatable contact brushes 18. For purposes of illustration, alternator 10 has been illustrated as including stator coils 20, with generation of electrical current effected by high speed rotation of rotor shaft 12 such as by drive belt 22. In an automobile alternator for which the present slip ring assembly 16 is particularly adapted, rotational speed is typically on the order of 12,000 rpm.

As discussed above, the present slip ring assembly 16 has been particuarly configured for efficient and economical fabrication. To this end, slip ring assembly 16 includes a unitary (i.e., one-piece) body 24 which can be very efficiently formed from electrically non-conductive, injection molded material. Suitably heat-resistant nylon or the like can readily be employed.

The body 24 has been configured for mounting on rotor shaft 12, and has further been configured for efficient assembly of the slip ring and terminal members of the slip ring assembly 16, as will be further described. Accordingly, body 24 is formed with a generally cylindrical configuration, and defines a generally cylindrical axial bore 26 for receiving the rotor shaft 12 therein. Circumferentially spaced mounting lugs 28 (three being shown) can be integrally formed within bore 26 to facilitate mounting of slip ring assembly 16 on rotor shaft 12 by a press or interference fit. Convenient final assembly of alternator 10 is thus facilitated.

As best shown in FIG. 2, body 24 defines first and second, axially spaced outer peripheral surfaces 30 and 32 which are disposed on respective opposite sides of a relatively enlarged, circumferential land 34. Significantly, the first outer peripheral surface 30 includes a first axially extending channel 36, while second outer peripheral surface 32 includes a second axially extending channel 38. As best shown in FIG. 4, channel 38 is aligned and communicates with an internal passage 40 defined by body 24. Passage 40 is disposed radially inwardly of first outer peripheral surface 30. By the provision of first and second channels 36 and 38, and internal passage 40, the terminal and slip ring elements of slip ring assembly 16 can be very easily assembled with the body 24 after injection molding of the body.

Slip ring assembly 16 further includes first and second electrically conductive, annular slip ring members 42 and 44. These cylindrical members are respectively positioned on the first and second outer peripheral surfaces 30 and 32 of body 24, with the slip ring members 42 and 44 thus positioned in axially spaced relation on the body 24 for electrical contact with brushes 18 of alternator 10 (see FIG. 1). The axial spacing of slip ring members 42 and 44, as well as their disposition on opposite sides of circumferential land 34, acts to electrically isolate the slip ring members from each other. Slip ring members 42 and 44 can be formed from suitably electrically conductive metallic material such as copper or the like, and can be very efficiently formed from a tubular extrusion.

In the embodiment illustrated in FIGS. 1–5, retention of slip ring members 42 and 44 on the body 24 is effected by way of an interference fit between the slip ring members and the body. The outer peripheral surfaces 30 and 32 of body 24 can be formed with a slight draft angle on the order of 0.25–0.5 degrees, with an additional interference between the slip ring members 42 and 44 and the body 24 on the order of 0.002 inches providing secure retention of the slip ring members on the body.

Slip ring assembly 16 further includes first and second electrically conductive terminals 46 and 48 which are configured to be respectively electrically joined to the first and second slip ring members 42 and 44. To this end, first terminal 46 is configured to extend axially of body 24 from within first channel 36, and outwardly of the end of body 24 adjacent first slip ring member 42. First terminal 46 is electrically joined with first slip ring member 42 at 50 such as by suitable soldering or the like, with the terminal suitably radiused at 50 for enhanced contact with the slip ring member. Use of a silver solder "ribbon" for formation of the electrical interface at 50 between terminal 46 and slip ring member 42 has been found to desirably provide low internal resistance for the resultant assembly.

Second terminal 48 is similarly electrically joined to second slip ring member 44 at 52. As illustrated in FIG. 4, second terminal 48 extends axially of body 24 from within second channel 38, and through passage 40 spaced inwardly of first slip ring member 42. The terminal 48 further extends outwardly of the end of body 24 which is adjacent to first slip ring member 44. In the preferred form, first and second terminals 46 and 48 are diametrically opposed with respect to axial bore 26. The terminals 46 and 48 respectively include offset portions 54 and 56 which extend beyond the end of body 24, and which are positioned radially inwardly of slip ring members 42 and 44. Portions 54 and 56 of terminals 46 and 48 provide suitable connections for wiring to the rotor assembly 14 of alternator 10.

From the above description, the method of making slip ring assembly 16 will be readily appreciated. Body 24 can be very efficiently injection molded by conventional techniques, with slip ring members 42 and 44 efficiently formed from a metallic tubular extrusion, and with terminals 46 and 48 efficiently formed from electrically conductive metallic material by stamping or the like. The terminals 46 and 48 are preferably respectively electrically joined to the slip ring members 42 and 44 prior to positioning of the terminals and the slip ring members on the body 24.

Figure 7:
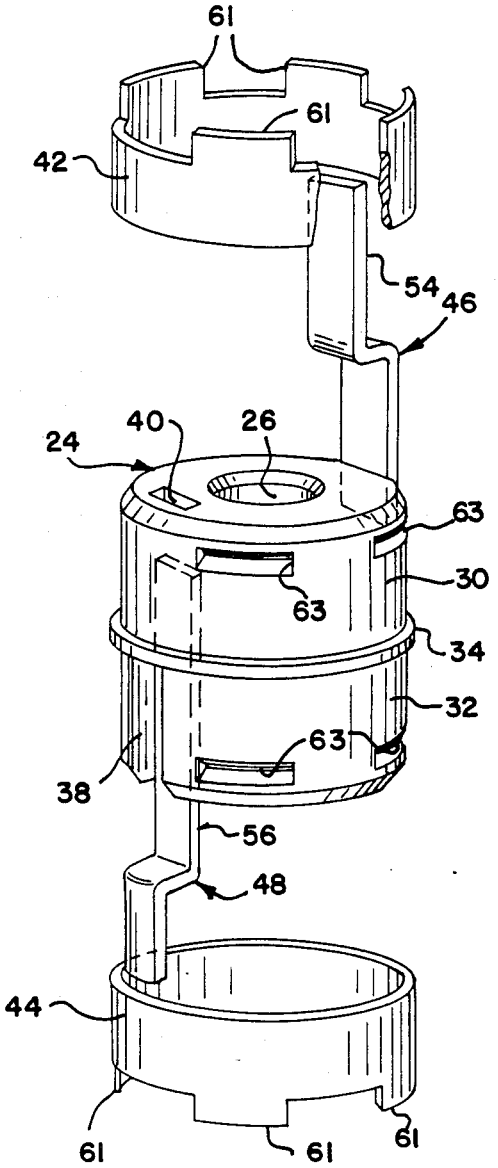
FIG. 7 is an exploded perspective view of the slip ring assembly shown in FIG. 6.
Figure 8:
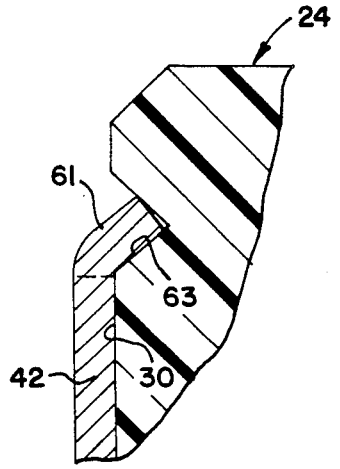
FIG. 8 is a partial cross-sectional view taken generally along lines 8—8 of FIG. 6.

Referring now to FIGS. 6–8, therein is illustrated an alternate embodiment of the present slip ring assembly, designated 16'. Slip ring assembly 16' is very similar in construction to previously described assembly 16, and thus like reference numerals have been employed for designating its various elements. In distinction from the previous described embodiment, slip ring assembly 16' includes an arrangement for positively locking slip ring members 42 and 44 in position on body 24. Specifically, each of the slip ring members 42 and 44 is provided with a plurality of circumferentially spaced, integral deformable retaining tabs 61. Further, body 24 is configured to define a corresponding number of retaining notches 63 for respectively receiving retaining tabs 61.

After terminals 46 and 48 are respectively joined to slip ring members 42 and 44, the terminals and slip ring members are positioned on the molded body 24. Retaining tabs 61 are thereafter suitably swaged or otherwise deformed so that the tabs are interengaged with the body 24 by disposition in retaining notches 63, as shown in FIGS. 6 and 8. While body 24 has been illustrated as configured for interengagement with tab 61 by the formation of retaining notches 63, it will be appreciated that other arrangements, such as the formation of a suitable groove or the like in body 24, can be provided for effecting the desired cooperation with retaining tabs 61 for retention of slip ring members 42 and 44 on body 24.

Thus, a slip ring assembly configured in accordance with the teachings herein can be very efficiently formed by injection molding techniques. Notably, formation of the present assembly as described permits its dimensions to be relatively less than the dimensions of a slip ring assembly formed by compression molding. For example, a current embodiment of the present assembly has provided with an external diameter of approximately 0.75 inches at the slip ring members 42 and 44. A compression molded assembly for an automobile alternator which the above current embodiment is intended to replace has an external diameter in excess of approximately 1.0 inches. This reduction in diameter, which is permitted by the formation techniques of the present invention, not only results in material savings, but also acts to relatively lower the peripheral speed of the assembly for a given rotational speed, thus desirably reducing the wear of associated contact brushes 18.

From the foregoing, it will be observed that numerous modifications and variations can be effected by those skilled in the art without departing from the true spirit and scope of the novel concept of the present invention. It is to be understood that no limitation with respect to the specific embodiments is intended or should be inferred. The present disclosure is intended to cover by the appended claims all such modifications as fall within the scope of the claims.

I claim:

1. A slip ring assembly for mounting on a rotatable rotor shaft of an electrical apparatus having relatively fixed brush means, comprising:

an electrically non-conductive one-piece injection molded body defining an axial bore for receiving said rotor shaft therein, said body defining first and second axially spaced outer peripheral surfaces separated by a relatively enlarged circumferential land, said first peripheral surface including a first axially extending channel, said second peripheral surface including a second axially extending channel;

first and second electrically conductive annular slip ring members respectively positioned on said first and second peripheral surfaces of said body, said slip ring members being positioned for electrical contact with said brush means; and first and second electrically conductive terminals, said first terminal being electrically joined to said first slip ring member and extending from within said first channel outwardly of an end of said body adjacent said first slip ring member, said second terminal being electrically joined to said second slip ring member and extending from within said second channel, through said body inwardly of said first slip ring member, and outwardly of said end of said body, said molded body defining an axially extending internal passage positioned inwardly of said first slip ring member, said second terminal extending through said internal passage and being electrically insulated from said first annular slip ring member by an integral portion of said one-piece body which said portion is positioned between said second terminal and said first annular slip ring member, said second axially extending channel having a radially inward surface which is radially aligned and generally contiguous with a radially inward surface of said axially extending internal passage, said radially inward surface of said second channel being spaced inwardly of at least a portion of said second terminal.

2. A slip ring assembly in accordance with claim 1, including means for retaining said annular slip ring members on said molded body comprising interference fit means between said body and said slip ring members.

3. A slip ring assembly in accordance with claim 1, wherein said first and second terminals are diametrically opposed with respect to said axial bore of said body, each of said terminals including a portion extending beyond said end of said body which is offset radially inwardly with respect to said annular slip ring members.

4. A slip ring assembly in accordance with claim 1, including means for retaining said annular slip ring members on said molded body comprising tab means on each said slip ring member interengaged with said body.

* * * * *